US005540163A

United States Patent [19]

Reinhart et al.

[11] Patent Number: 5,540,163

[45] Date of Patent: Jul. 30, 1996

[54] PNEUMATIC APPARATUS FOR INDEPENDENTLY MOVING ONE OF TWO PRESSER FOOT SOLE PLATES

[75] Inventors: Terry L. Reinhart, Findlay; Vaughn J. Piper, Elida, both of Ohio

[73] Assignee: Findlay Industries, Inc., Findlay, Ohio

[21] Appl. No.: 399,225

[22] Filed: May 8, 1995

[51] Int. Cl.[6] ..... D05B 29/08

[52] U.S. Cl. ..... 112/235

[58] Field of Search ..... 112/235, 60, 147, 112/237, 239

[56] References Cited

U.S. PATENT DOCUMENTS

| | | | |
|---|---|---|---|
| 621,145 | 3/1899 | Rontke | 112/235 |
| 1,852,482 | 7/1932 | Seavers et al. | 112/235 |
| 2,481,286 | 9/1949 | Bouwkamp et al. | 112/235 |
| 2,611,333 | 3/1952 | Ritter | 112/235 |
| 2,652,016 | 9/1953 | Enos | 112/235 |
| 2,807,225 | 9/1957 | Pisano | 112/235 |
| 3,661,102 | 5/1972 | Tice | 112/239 X |
| 3,796,173 | 3/1974 | Godsen | 112/235 |
| 4,777,893 | 10/1988 | Bauer et al. | 112/235 |

FOREIGN PATENT DOCUMENTS

| | | | |
|---|---|---|---|
| 0857154 | 10/1952 | Germany | 112/235 |
| 0291362 | 6/1991 | Germany | 112/235 |
| 0002395 | 1/1986 | Japan | 112/235 |
| 2240554 | 8/1991 | United Kingdom | 112/235 |

*Primary Examiner*—Ismael Izaguirre
*Attorney, Agent, or Firm*—Sidney W. Millard

[57] ABSTRACT

A support block is attached to the lower end of a presser foot lifter shaft of a sewing maching to support two separately mounted sole plates of 9 presser foot. One of the sole plates is mechanically retractable by a pneumatic piston and cylinder combination at the option of the operator and this is accomplished by an extension of the piston rod which is mechanically connected to one of the sole plates.

15 Claims, 1 Drawing Sheet

PNEUMATIC APPARATUS FOR INDEPENDENTLY MOVING ONE OF TWO PRESSER FOOT SOLE PLATES

FIELD OF THE INVENTION

This invention relates to a presser foot used in association with sewing machines wherein one of the sole plates is retractable by a pneumatic piston and cylinder combination.

BACKGROUND OF THE INVENTION

In certain specialized areas of sewing in a commercial facility particularly as occurs in the sewing of seat covers for automobiles, it often occurs that the seam being sewn is on meshing workpieces where one work piece is at a considerably different elevation than the other workpiece. When that occurs the operator is compelled to try to balance the sole plates so that one sole plate rides on the higher workpiece while the other sole plate is unsupported above the lower workpiece. The difficulty is obvious and various inventive concepts have been put forward to solve the problem.

The patent to Rontke, U.S. Pat. No. 621,145, shows a pair of sole plates which are longitudinally spaced but which also allow transverse vertical sliding with respect to each other. The particular structure shown does not solve the problem of transverse elevation differential but the concept illustrated in the patent could be applied in that fashion.

The patent to Seavers et al, U.S. Pat. No. 1,852,482, shows the problem in FIG. 4 and the solution suggested by the patent is to have one of the sole plates vertically biased to its lower position by a spring while the other sole plate is maintained in rigid position.

The patent to Bouwkamp et al, U.S. Pat. No. 2,481,286, shows a pair of presser feet which are mounted transversely of a center post and are allowed to adjust vertically according to the pivoting lever which pivots from the center post and allows vertical movement of the two transversely aligned presser feet.

The patent to Enos, U.S. Pat. No. 2,652,016, illustrates another embodiment using a spring bias of one of the sole plates of the presser foot to move with respect to the other rigidly mounted sole plate.

The patent to Pisano, U.S. Pat. No. 2,807,225, uses a pair of coil springs for one sole plate to allow its vertical movement with respect to the other sole plate which is rigidly mounted. A patent to Godsen, U.S. Pat. No. 3,796, 132, has a similar inventive concept.

In summary, the prior patents illustrate the concept of a pressor foot with one of its sole plates rigidly mounted while the other is allowed to move vertically and is biased into place in some instances by a spring.

SUMMARY OF THE INVENTION

This invention addresses the same problem of providing for sole plates having a differential elevation but this invention includes apparatus having the two sole plates in the complete control of the operator of the sewing machine rather than sliding uncontrolled spring biased sole plates which inherently have varying pressures applied to the upper surface of the workpieces.

This invention provides for retraction of one of the sole plates by a piston and cylinder combination which is activated by pneumatic systems controlled by a manual on and off switch. Accordingly when normal sewing is contemplated by the machine operator, the switch is activated or deactivated to cause the piston to drive the adjustable sole plate into parallel position with the rigid sole plate. Thereby both sole plates are aligned in operative position and are not mushy in their application of pressure to the upper surface of the workpiece or workpieces.

On the other hand, where the workpieces being sewn have a differential elevation transversely across the seam area, the switch is activated to retract the piston within the cylinder and thereby lift the adjustable sole plate from the surface of the workpiece, completely out of contact therewith. This allows the stationary sole plate to press against the surface of the workpiece at the lower level and there is no differential pressure applied by the opposite workpiece at the higher elevation of the workpiece.

What is different about this invention is the piston and cylinder combination for positively raising or lowering one of the sole plates of the pressure foot rather than the sliding spring biased operations of the prior art.

Objects of the invention not understood from the above description will be appreciated fully upon a review of the drawings and the description of the preferred embodiment which follows.

DESCRIPTION OF THE PREFERRED EMBODIMENT

Figure 1:
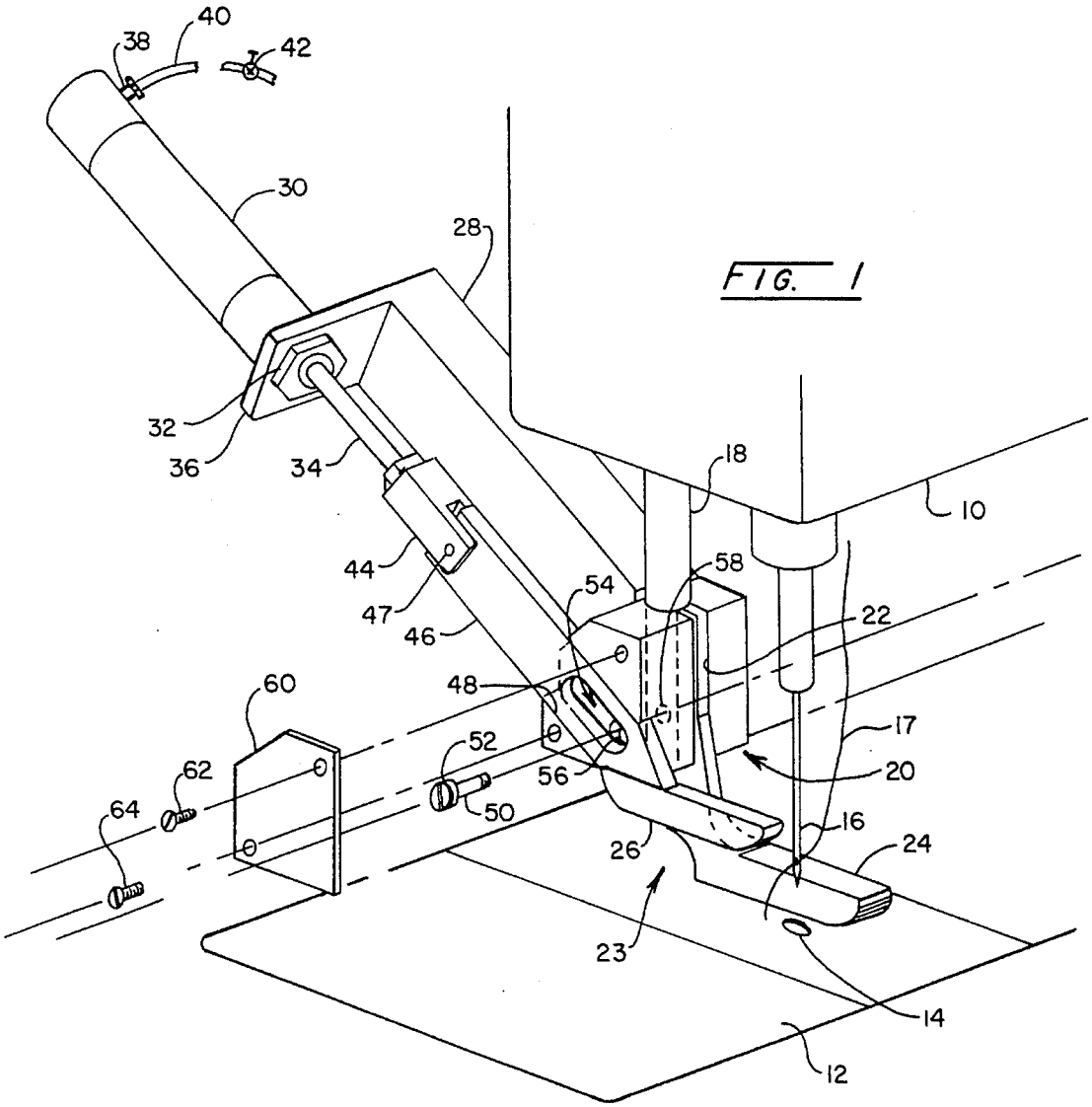
FIG. 1 is a perspective view of the pressure foot of this invention with one sole plate retracted.

A sewing machine 10 includes a work surface 12 with a hole 14 therein to receive the vertical reciprocation of a needle 16 and thread 17 combination which is conventional.

A pressure foot lifting shaft 18 on machine 10 is mechanically connected to a support block 20.

A slotted lower end (not shown) of the pressure foot lifter shaft is designed to receive the insertion of the shank 22 of a pressure foot 23.

In this case the pressure foot 23 includes a rigidly mounted sole plate 24 and a retractable sole plate 26. Both are supported on support block 20.

Support block 20 includes a support arm 28 projecting rearedly from the support block at about a forty-five degree angle. It is intended that the support arm be aligned on the sewing machine 10 in a direction away from where the machine operator is sitting to thereby prevent any visual obstructions to the sewing operation.

Support arm 28 is connected to a piston and cylinder combination 30 by a nut 32 which tightens around a piston rod 34 against a flange 36 which projects transversely from arm 28.

At the remote end of piston and cylinder combination 30 is a fitting 38 connected to a hose or line 40 which, in turn, is connected to a source of air under pressure (not shown). Actuation and deactuation of the piston and cylinder combination is accomplished by a manual switch 42.

Piston rod 34 includes a clevis 44 connected at its remote end to a piston rod extension 46 which projects into a passage 48 extending through support block 20. Clevis 44 is secured to extension 46 by a transversely extending pin 47 which allows a bit of lost motion play between the two elements. Piston rod extension 46 is allowed to slide in reciprocating fashion within passage 48 upon actuation of the piston and cylinder combination 30 and it is guided and limited in its direction of movement by a threaded screw 50. Screw 50 is threaded into block 20 with its head 52 projecting into a slot 54 in rod extension 46, head 50 being smaller in diameter than the width of slot 54. Screw 50 projects passage opening 56 in support block 20 and on through a second opening 58 in the slotted end of pressure foot lifter shaft 18.

Depending upon the desired structure, the inner end of screw 50 may press against shank 22 of the pressure foot 23 or may pass through an opening therein and on into the other side of support block 20 where it may thread into another threaded opening. The point is, screw 50 serves a plurality of purposes. It locks shank 22 to the pressure foot lifter shaft 18; it mechanically secures support block 20 to the lifter shaft; and it guides and limits the movement of extension 46 by its head 52 projecting into slot 54 from the pressure block.

To hold extension 46 within passage 48, a cover plate 60 is secured on the face of support block 20 by screws 62, 64 and thereby the head 52 of screw 50 is completely covered and the extension 46 is prevented from accidently moving transversely due to a loose fit of the clevis 44 which could allow the displacement of the extension away from the stud formed by the head 52 of the screw 50.

Figure 2:
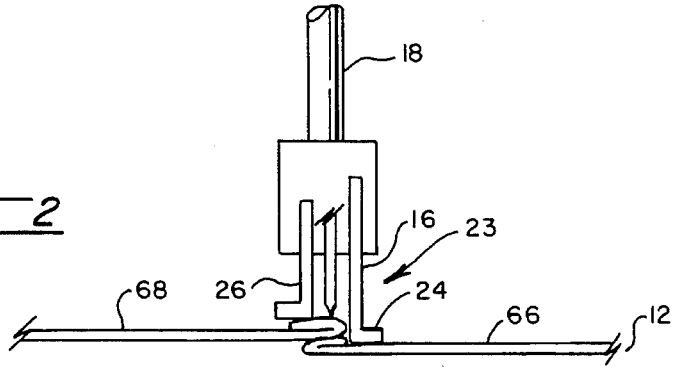
FIG. 2 is a front elevational schematic view of the pressure foot of this invention.

Looking particularly to FIG. 2, a thin workpiece 66 and a thick workpiece 68 are folded at their edges to receive a seam sewn by needle 16. As a result there is a differential in elevations across the seam area. This makes it difficult for the machine operator to sew a straight seam under normal conditions because of the rigid mounting of the sole plates. In this instance this problem is eliminated by retraction of sole plate 26 by the actuation of switch 42 which either applies a pneumatic force or releases the pneumatic force to allow a spring to operate on the piston within the piston and cylinder combination 30.

Specifically this invention allows the operator to retract one sole plate 26 completely out of the work area while leaving one sole plate 24 in its lower operating position when the pressure foot lifter shaft 18 has been depressed in normal conventional fashion. The operator also has the option where there is essentially no elevation differential across the seam area to throw switch 42 to cause both sole plates to be at the same elevation and perform their usual function while being held in rigid position.

Having thus described the invention in its preferred embodiment, it will be clear to those with ordinary skill in the art that various modifications may be made to the structure illustrated without departing from the spirit of the invention. Accordingly, it is not intended that the invention be limited by the description of the preferred embodiment nor the drawings illustrating the same. It is intended that the invention be limited only by the scope of the appended claims.

We claim:

1. A presser foot for use in a sewing machine comprising, a pair of sole plates having a gap therebetween to accommodate a vertically reciprocating needle and thread, a support block connecting said sole plates together, said support block being mechanically attachable to a presser foot lifter shaft on a sewing machine, a piston rod and cylinder combination being mechanically secured to said support block, said piston rod projecting from said cylinder, extending through said support block and being mechanically attached to one of said sole plates, a line leading to said cylinder to provide for pneumatic actuation to move said piston rod, said attached sole plate being mounted to said support block and piston rod for vertical movement in response to movement of said piston in said cylinder.

2. The presser foot of claim 1 wherein said piston rod includes an extension having a transversely extending slot, a stud extending from said support block into said slot to guide said rod and limit its movement.

3. The presser foot of claim 2 wherein said extension of said rod through said support block is through means forming a passageway through said block, said stud extension from said block is within said passageway.

4. The presser foot of claim 3 including a support arm mechanically secured to both said support block and said cylinder for holding said block and cylinder in a rigid position.

5. The presser foot of claim 4 wherein said stud projects from said slot through said support block to a location engagable with said presser foot lifter shaft.

6. The presser foot of claim 5 wherein the other of said sole plates is mechanically connected in relatively immoveable position to said support block.

7. The presser foot of claim 6 wherein said rod extension is connected to said rod by a clevis and pin.

8. The presser foot of claim 2 including a support arm mechanically secured to both said support block and said cylinder.

9. The presser foot of claim 8 wherein said stud projects from said slot through said support block to a location engagable with said presser foot lifter shaft.

10. The presser foot of claim 9 wherein the other of said sole plates is mechanically connected in relatively immoveable position to said support block.

11. The presser foot of claim 10 wherein said rod extension is connected to said rod by a clevis and pin.

12. The presser foot of claim 2 wherein said stud projects from said slot through said support block to a location engagable with said presser foot lifter shaft.

13. The presser foot of claim 2 wherein said rod extension is connected to said rod by a clevis and pin.

14. The presser foot of claim 1 including a support mechanically secured to both said support block and said cylinder.

15. The presser foot of claim 1 wherein the other of said sole plates is mechanically connected in relatively immoveable position to said support block.

* * * * *